US005141418A

United States Patent [19]

Ohtaki et al.

[11] Patent Number: 5,141,418

[45] Date of Patent: Aug. 25, 1992

[54] VARIABLE CAPACITY TYPE VANE PUMP WITH A VARIABLE RESTRICTION ORIFICE

[75] Inventors: Mizuo Ohtaki; Teruhiko Mochizuki; Yoshio Okubo; Miyoko Hamao, all of Kanagawa, Japan

[73] Assignee: Atsugi Unisia Corporation, Kanagawa, Japan

[21] Appl. No.: 734,918

[22] Filed: Jul. 24, 1991

[30] Foreign Application Priority Data

Jul. 25, 1990 [JP] Japan ..... 2-197545
Jun. 26, 1991 [JP] Japan ..... 3-154468

[51] Int. Cl.[5] ..... F04C 15/02

[52] U.S. Cl. ..... 418/26; 418/30; 418/268; 417/310

[58] Field of Search ..... 418/30, 181, 268, 270, 418/24, 25, 26; 417/309, 310

[56] References Cited

U.S. PATENT DOCUMENTS 3,756,749 9/1973 Aldinger ..... 418/26
4,557,670 12/1985 Inagaki et al. ..... 417/309
4,722,652 2/1988 Jingin et al. ..... 418/268
4,737,078 4/1988 Dantloraber ..... 418/26
4,927,332 5/1990 Fisher et al. ..... 417/310

FOREIGN PATENT DOCUMENTS 58-18582 2/1983 Japan ..... 418/30
60-53688 3/1985 Japan ..... 418/30

*Primary Examiner*—Richard A. Bertsch
*Assistant Examiner*—David L. Cavanaugh
*Attorney, Agent, or Firm*—Bachman & LaPointe

[57] ABSTRACT

A variable capacity type vane pump comprising a cam ring, a rotor placed for rotation within the cam ring. The rotor has a number of radial slots, and vances placed for radial inward and outward movement in the receptive slots each having a bottom. A pump chamber is defined between the cam ring and the rotor and it has an inlet and outlet port. The outlet port is connected through a conduit to the bottom of at least one of the slots having vanes moving inwardly in the respective slots. A restriction orifice is placed in the conduit. The cam ring is moved with respect to the rotor to vary the capacity of the vane pump in response to a pressure differential across the restriction orifice.

7 Claims, 7 Drawing Sheets

VARIABLE CAPACITY TYPE VANE PUMP WITH A VARIABLE RESTRICTION ORIFICE

BACKGROUND OF THE INVENTION

This invention relates to a variable capacity type vane pump for use in power steering unit or the like.

Automotive vehicles employ variable capacity type vane pumps having its discharge amount variable in accordance with the speed of rotation of the pump to control power steering control. For example, Japanese Utility Model Kokai No. 59-159793 discloses a conventional variable capacity type vane pump. The conventional vane pump, shown in FIG. 7, includes a pump housing A which houses a drive shaft B, a cam ring C and a rotor D fixed on the drive shaft B for rotation in unison therewith within the cam ring C. The drive shaft B is drivingly connected to the engine to rotate in a counter-clockwise direction, as viewed in FIG. 7, indicated by the arrow. The rotor D has a number of vanes E provided for radial movement in respective radial slot F equally spaced circumferentially of the rotor D. With rotation of the drive shaft B, the rotor D rotates with the vanes held in sliding contact with the inner cam surface of the cam ring C to introduce oil into the vane pump through an inlet port G and discharge pressurised oil from the vane pump through an outlet port H. The pressurized oil is supplied to a power steering control valve through an output conduit I having a restriction orifice J.

A control mechanism K is provided to control the concentric amount e of the center 02 of the cam ring C with respect to the center 01 of the rotor D so as to vary the displacement of the vane pump. This control is made based upon an oil pressure differential across the restriction orifice J. For this purpose, the control mechanism K receives an oil pressure P1 introduced thereinto through a conduit L connected to the output conduit I at a position upstream of the restriction orifice J and an oil pressure P2 introduced thereinto through a conduit M connected to the output conduit I tat a position downstream of the restriction orifice J. As the speed of rotation of the drive shaft D increases, the amount of oil discharged through the outlet port H increases to increase the pressure differential (P1–P2) across the restriction orifice J. When the pressure differential across the restriction orifice J reaches a predetermined value, the control mechanism K rotates the cam ring C from its maximum eccentric position (FIG. 7) in a direction decreasing the eccentric amount e so as to decrease the amount of oil discharged through the outlet port H.

With the conventional vane pump, however, the fluid pressure P1 remains much greater than the fluid pressure P2. This causes a vane pump inner pressure increase which, in turn, causes power loss and oil temperature increase. This is stemmed from the fact that the restriction orifice J is provided in the output conduit I.

SUMMARY OF THE INVENTION

Therefore, a main object of the invention is to provide an improved vane pump which can suppress the vane pump inner pressure increase.

There is provided, in accordance with the invention, a vane pump of the type having a variable capacity. The vane pump comprises a cam ring, a rotor placed for rotation within the cam ring, the rotor having a number of radial slots, and vanes placed for radial inward and outward movement in the respective slots each having a bottom, a pump chamber defined between the cam ring and the rotor, the pump chamber having an outlet and inlet port, means for connecting the bottom of at least one of the slots having vanes moving inwardly in the respective slots to the outlet port of the pump chamber through a conduit, a restriction orifice placed in the conduit, and means for moving the cam ring with respect to the rotor to vary the capacity of the vane pump in response to a pressure differential across the restriction orifice.

BRIEF DESCRIPTION OF THE DRAWINGS this invention will be described in greater detail by reference to the following description taken in connection with the accompanying drawings, in which like numerals refer to like parts in the several views and in which:

FIG. 2 is a sectional view taken along the lines III—III of FIG. 2;

DETAILED DESCRIPTION OF THE INVENTION

Figure 1:
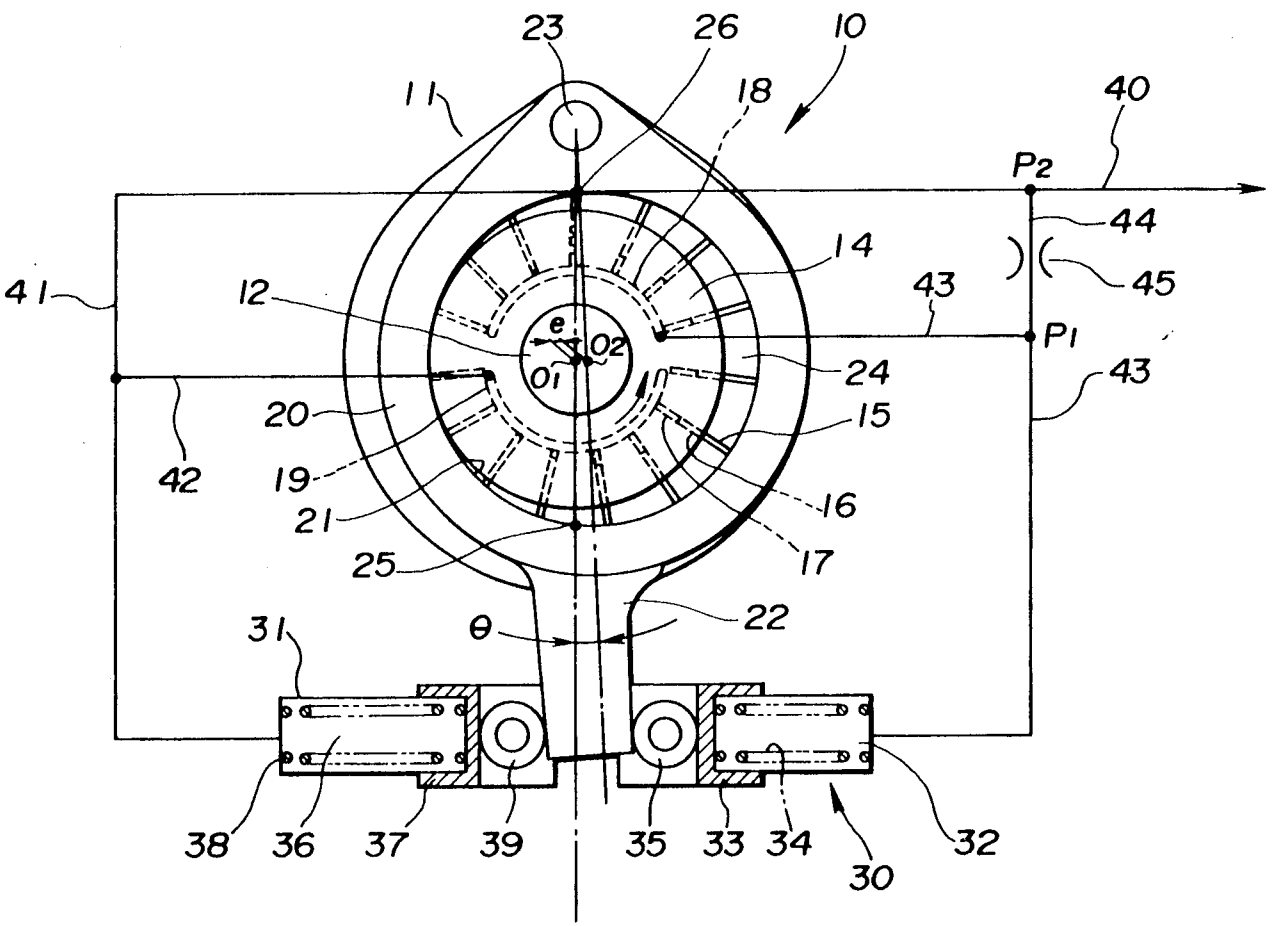
FIG. 1 is a schematic diagram showing one embodiment of a variable capacity type vane pump made in accordance with the invention.
Figure 2:
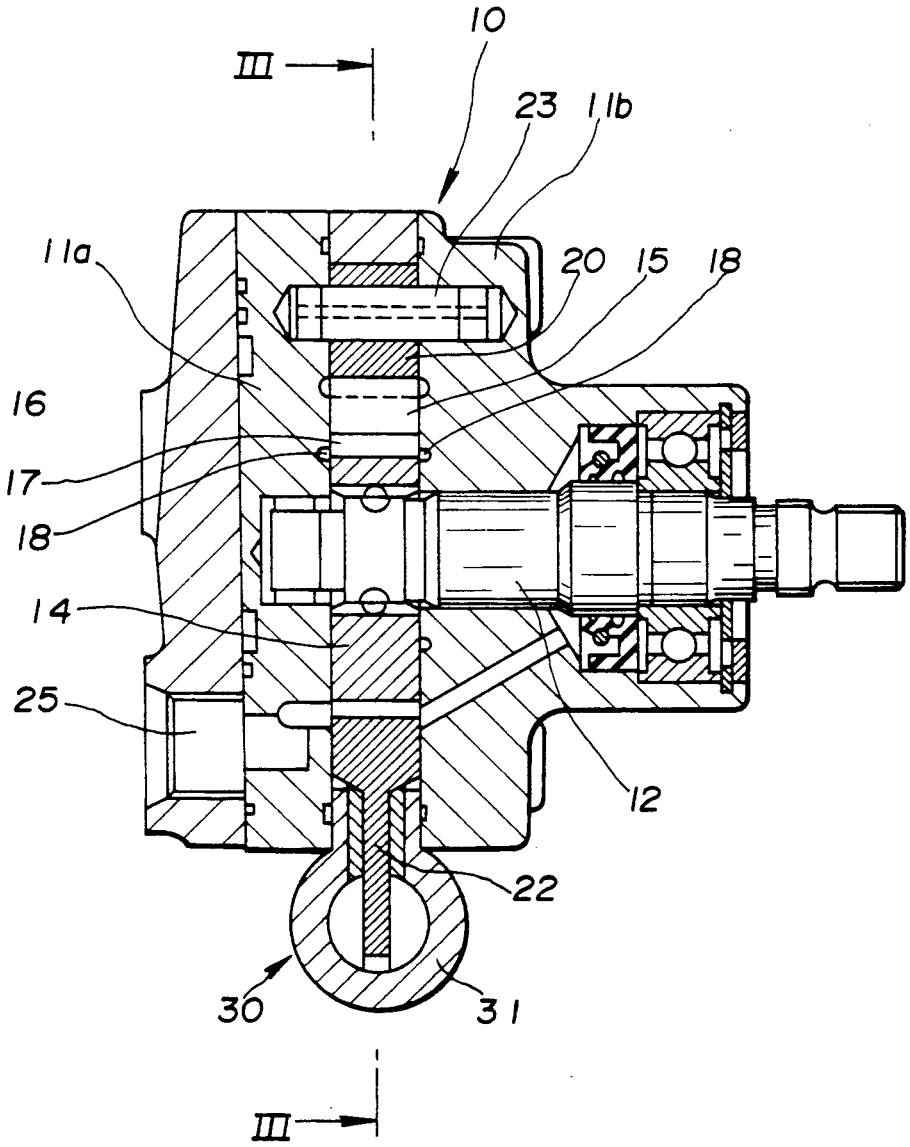
FIG. 2 is a longitudinal sectional view of the vane pump of FIG. 1.
Figure 3:
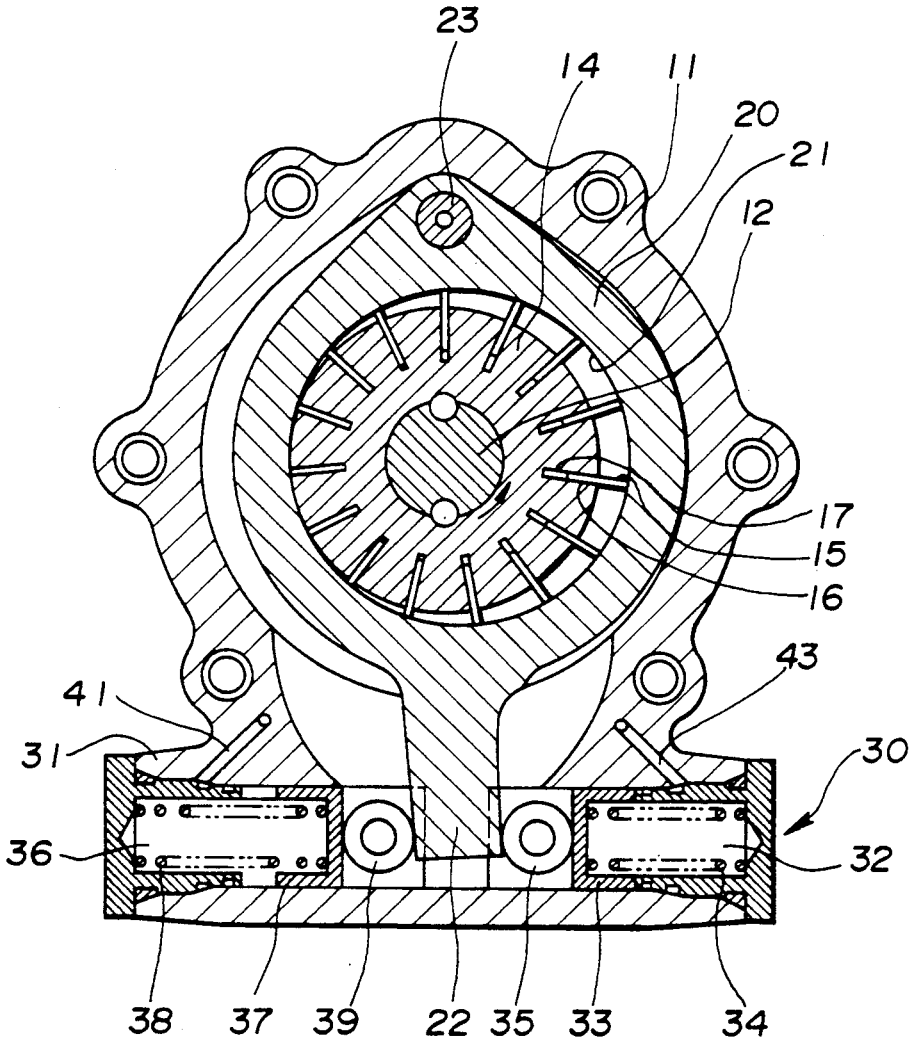

Referring to FIGS. 1 through 3, there is shown one embodiment of a variable capacity type vane pump made in accordance with the invention. The vane pump, generally designated by the numeral 10, includes a pump housing 11 comprised of a pump body 11*a* and a rear plate 11*b* placed in spaced-parallel relation to each other, as best shown in FIG. 2. The pump housing 11 receives a drive shaft 12, a rotor 14 and a cam ring 20. The drive shaft 12 extends through the pump housing 11. The rotor 14 is fixed on the drive shaft 12 for rotation in unison therewith within the cam ring 20. A pump chamber 24, which is defined between the rotor 14 and the cam ring 20, has an inlet port 26 formed at its lower position and an outlet port 26 formed at its upper position. The inlet and outlets ports 25 and 26 are arranged on a vertical diagonal line extending through the center 01 of the rotor 14. The rotor 14 has a number of vanes 15 placed for radial movement in respective radial slots 16 equally spaced circumferentially of the rotor 14. The cam ring 20 has an operation arm 22 integral therewith and it is pivoted as at 23 to the pump housing 11 for rotation in a clockwise and counter-clockwise direction about the pivot 23.

A control mechanism 30 is provided below the pump housing 11 for moving the operation arm 22 to rotate the cam ring 20 about the pivot 23 through an angle $\theta$ with respect to its neutral position to vary the eccentric amount e of the center 02 of the cam ring 20 with respect to the center 01 of the rotor 14. The control mechanism 30 includes a cylindrical casing 31 integral with the pump housing 11. The cylindrical casing 31 is closed at its opposite ends to provide first and second closed pressure chambers 32 and 36 on the opposite sides of the operation arm 22. The first pressure chamber 32 receives a first position 33 placed for reciprocating movement within the first pressure chamber 32. A compression spring 34 is placed in the first pressure chamber 32 to urge the first piston 33 in a direction pushing a resilient member 35 against one side of the operation arm 22 to rotate the cam ring 20 in the clockwise direction, as viewed in FIG. 1. The second pressure chamber 36 receives a second piston 37 placed for reciprocating movement within the second pressure chamber 36. A compression spring 38 is placed in the second pressure chamber 36 to urge the second piston 37 in the direction pushing a resilient member 39 against the opposite side of the operation arm 22 to rotate the cam ring 20 in the counter-clockwise direction, as viewed in FIG. 1. The compression coil spring 38 has the same resilient force as the compression coil spring 34.

With rotation of the drive shaft 12, the rotor 14 rotates in the counter-clockwise direction, as viewed in FIG. 1, with the vanes 15 having their outward ends held in sliding contact with the inner cam surface 21 of the cam ring 20 so as to pump the oil introduced from the inlet port 25 to the outlet port 26. The vanes 15, which are placed above a horizontal line extending through the center 01 of the rotor 14, that is, in the suction side of the pump chamber 24, move radially outwardly in the respective slots 16 due to the centrifugal forces applied thereto, whereas the vanes 16, which are placed below the horizontal line, that is, in the discharge side of the pump chamber 24, move radially inwardly in the respective slots 16.

A substantially semi-circular groove 18 is formed in the pump body 11*a* and/or the rear plate 11*b* to connect the bottoms 17 of the slots 16 placed in the discharge side of the pump chamber 24 where the respective vanes 15 moves radially inwardly. Similarly, another semi-circular groove 19 is formed in the pump body 11*a* and/or the rear plate 11*b* to connect the bottoms 17 of the slots 16 placed in the suction side of the pump chamber 24 where the respective vanes 15 move radially inwardly.

The pressurised oil discharged from the pump chamber 24 through the outlet port 26 is introduced through an outlet conduit 40 into a power steering control unit (not shown) and also through a conduit 41 into the second pressure chamber 36. The conduit 41 is connected through a conduit 42 to the groove 19 so as to introduce the discharged oil pressure to the bottoms 17 of the vanes 15 moving radially outwardly in the respective slots 16. The groove 18 is connected through a conduit 43 to the first pressure chamber 32. The conduit 43 is also connected to the output conduit 40 through a conduit 44 having a restriction orifice 45.

The operation is as follow:

Each slot 16 is supplied at its bottom 17 with an oil pressure through the groove 19 from the outlet port 26 when it is in the suction side of the pump chamber 24. The introduced oil pressure is pressurized by the radial inward movement of the corresponding vane 15 in the slot 16 when the slot 16 is the discharge side of the pump chamber 24. The pressurized oil pressure is discharged through the groove 18 to the conduit 43. As a result, the oil pressure P1 in the conduit 43 placed upstream of the restriction orifice 45 is higher than the oil pressure P2 in the conduit 40 placed downstream of the restriction orifice 45. The pressure differential (P1−P2) increases as the amount of the oil discharged from the groove 18, that is, as the pump speed increases. When the pressure differential (P1−P2) exceeds a predetermined value, the force acting on the operation arm 22 from the piston 33 overcomes the force acting on the operation arm 22 from the piston 37 to rotate the cam ring 20 from its maximum eccentric position (FIGS. 1 and 3) in the clockwise direction, as viewed in FIG. 1, reducing the eccentric amount e so as to reduce the amount of the oil discharged through the outlet port 26.

Figure 4:
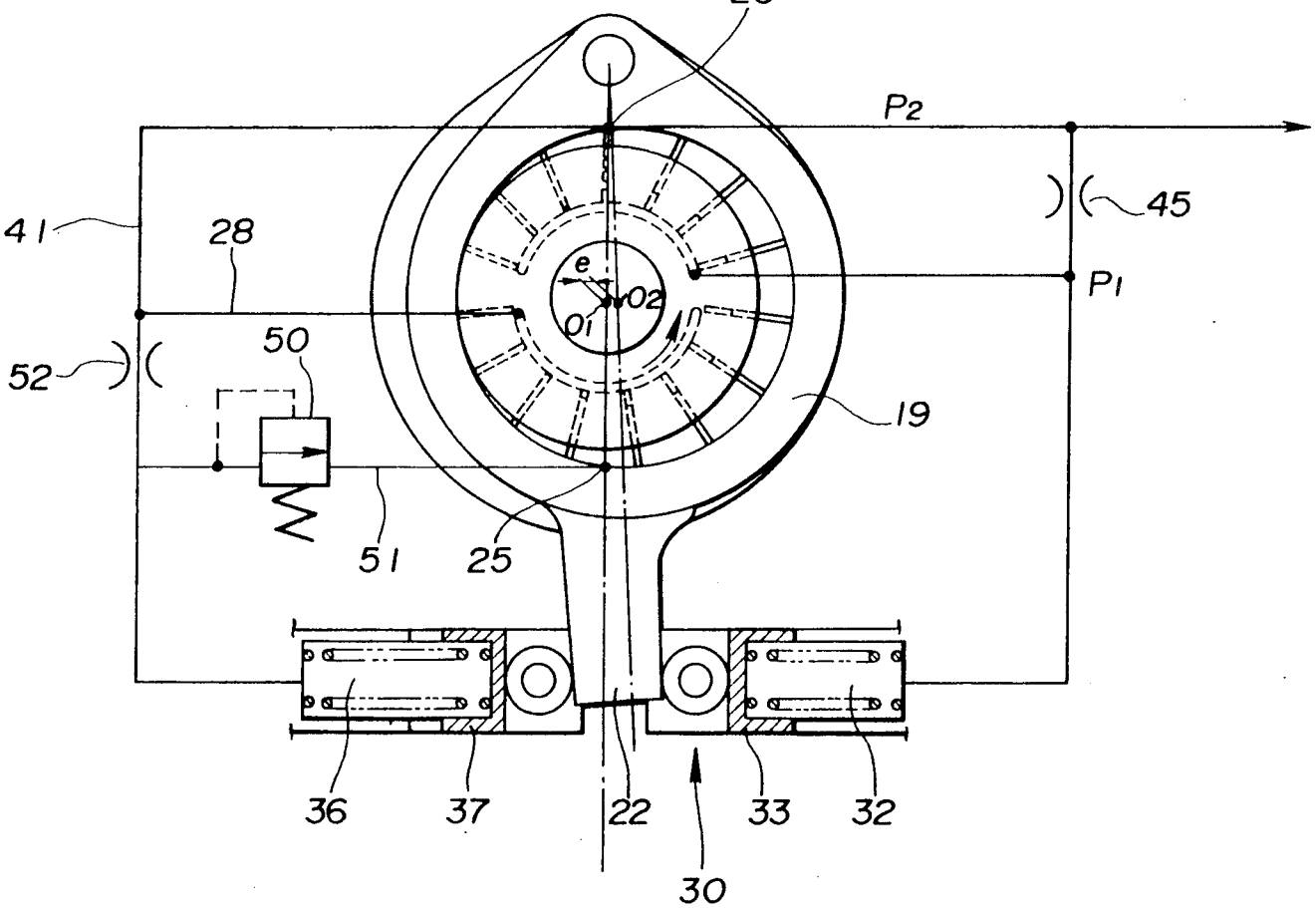
FIGS. 4 and 5 are schematic diagrams showing a modified form of the variable capacity type vane pump of the invention.
Figure 5:
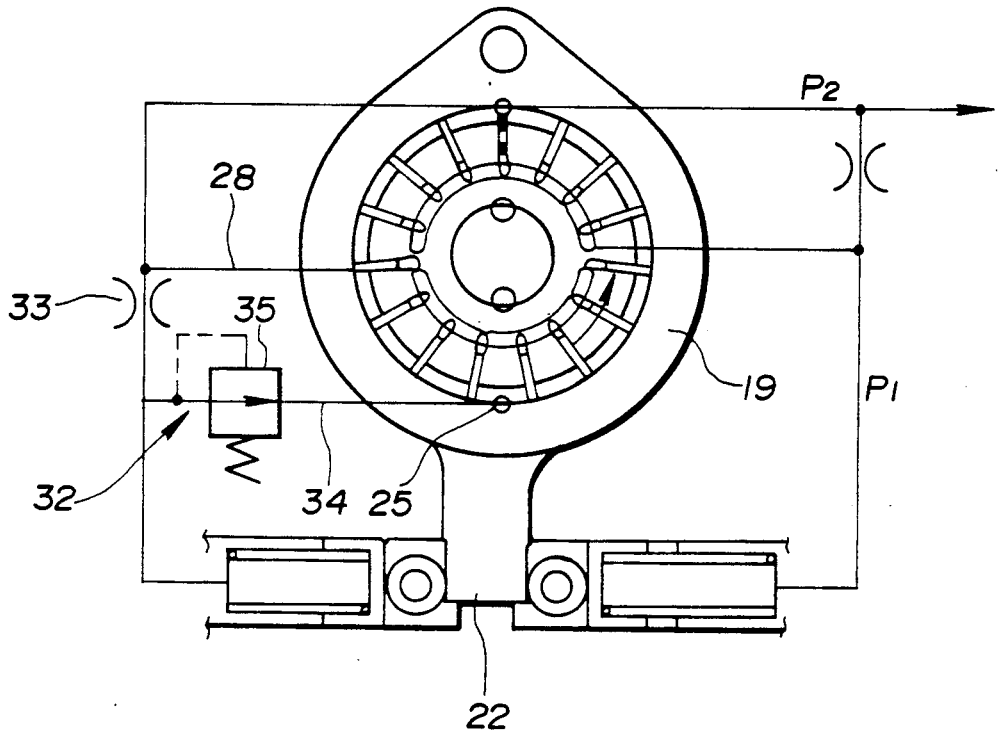

Referring to FIGS. 4 and 5, there is illustrated a modified form of the variable capacity type vane pump of the invention. In this modification, an adjustable relief valve 50 is provided in a conduit 51 connected between the conduit 41 and the inlet port 25 of the vane pump. The relief valve 50 responds to the pressure P2 at the outlet port 26 by relieving the pressure within the conduit 41 so as to equalize the pressure in the cylinder 36 to the pressure at the inlet port 25 when the pressure P2 at the outlet port 26 exceeds a predetermined value. As a result, the force acting on the operation arm 22 from the piston 33 overcomes the force acting on the operation arm 22 from the piston 37 to rotate the cam ring 20 in the clockwise direction, as viewed in FIG. 1, to its neutral position (FIG. 5) where the eccentric amount e is zero. This is effective to prevent the vane pump from working unnecessarily. It is, therefore, possible to further reduce the pump power consumption and further suppress oil temperature increase. Preferably, a restriction orifice 52 is provided in the conduit 41 at a position between the conduits 28 and 51 to regulate the pressure P2 at the outlet port 26 of the vane pump.

Figure 6:
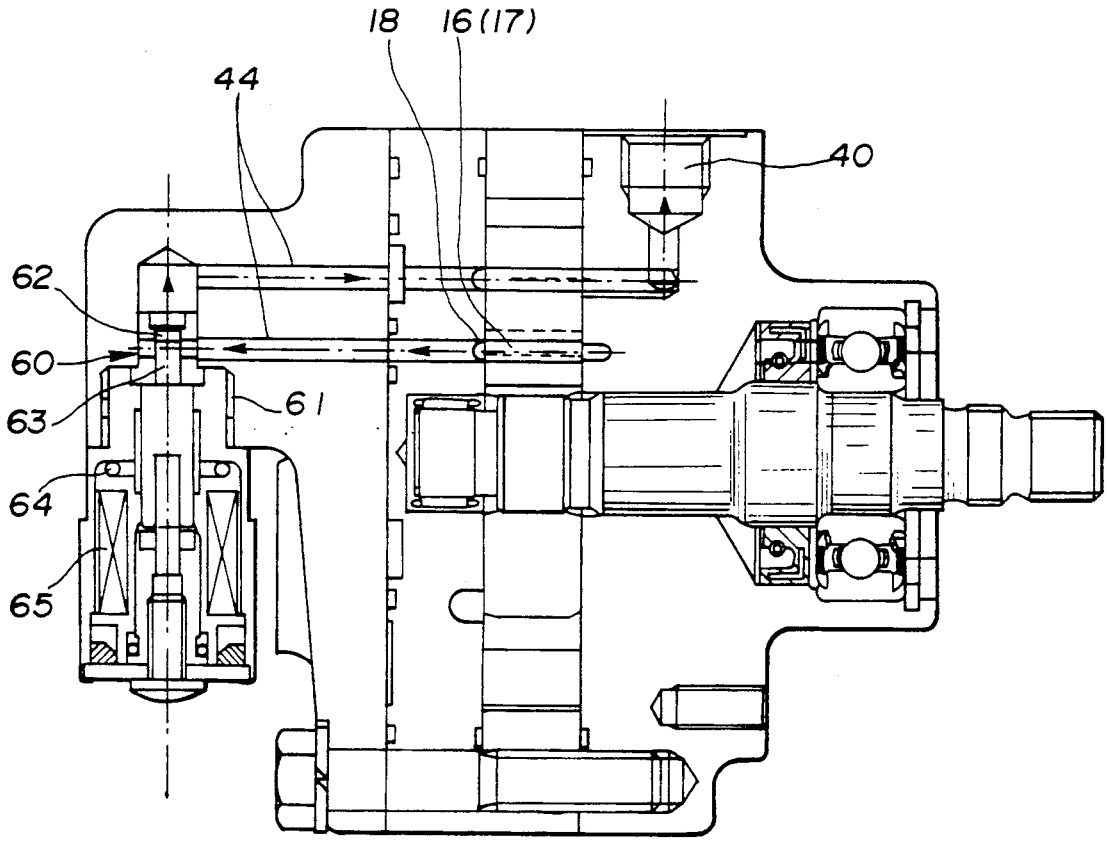
FIG. 6 is a schematic diagram showing another modified form of the variable capacity type vane pump of the invention.
Figure 7:
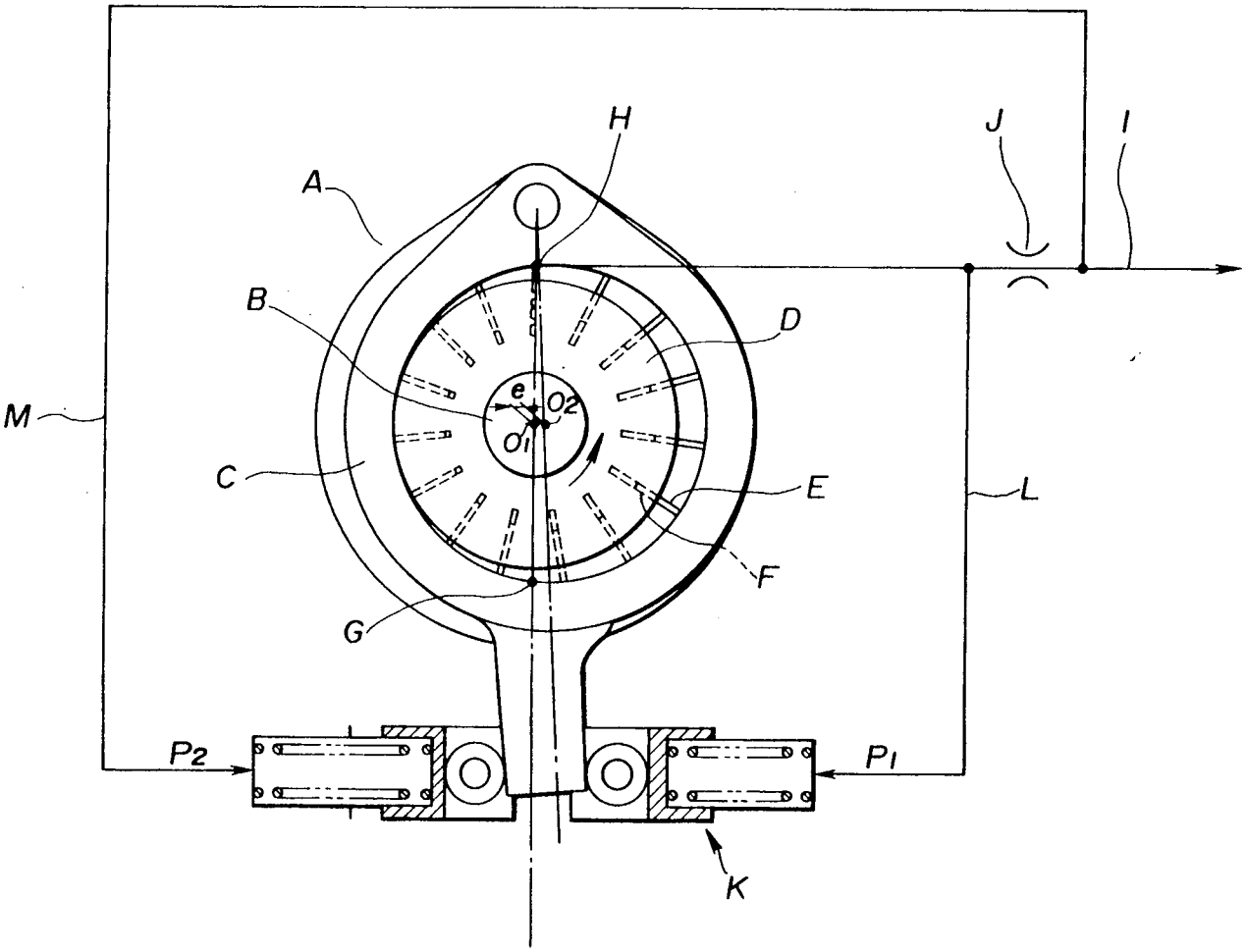
FIG. 7 (PRIOR ART)
FIG. 7 is a schematic view showing a conventional variable capacity type vane pump.

Referring to FIG. 6, there is shown another modified form of the variable capacity type vane pump of the invention. In this embodiment, the restriction orifice 45 is replaced with an restriction orifice 60 of the type having a variable effective area. The variable-area type orifice 60 includes a housing 61 having a fixed metering orifice 62. A plunger 63 is supported within the housing 61 for reciprocation into and out of the fixed orifice 62. A bias spring 64 is seated between the rearward end of the plunger 63 and the housing 61 to bias the plunger 63 toward its position fully opening the orifice 62. An electrical winding 65 is electromagnetically coupled with the plunger 63. When the electrical winding 65 is energized by the presence of electrical current within it, the plunger 63 moves into the orifice 62 to reduce the effective area of the orifice 62. The electrical current is applied to the electrical winding 65 from a control unit (not shown) which varies the effective area of the orifice 62 according to vehicle operating conditions including vehicle speed, etc. so as to operate the vane pump with higher efficiency.

According to the invention, no restriction orifice is provided in a conduit connected between the outlet port of the vane pump and the power steering control valve. This is effective to avoid pump internal pressure increase, suppress oil temperature increase, and minimize power less. When the variable capacity type vane pump of the invention is used with a vehicle power steering unit, the drive shaft 2 is driven by the vehicle engine. It is, therefore, possible to adjust the oil pressure introduced to the power steering unit according to engine speed.

Although this invention has been described in conjunction with specific embodiments thereof, it is evident that many alternatives, modifications and variations will be apparent to those skilled in the art. For example, the invention is equally applicable to vane pumps of the type having a pump chamber whose volume is varied by rotating a cam ring having eccentric inner and outer peripheral surfaces. Accordingly, it is intended to embrace all alternatives, modifications and variations that fall within the scope of the appended claims.

What is claimed is:

1. A vane pump of the type having a variable capacity, comprising:

a cam ring;

a rotor placed for rotation within the cam ring, the rotor having a number of radial slots, and vanes placed for radial inward and outward movement in the respective slots each having a bottom;

a pump chamber defined between the cam ring and the rotor, the pump chamber having an inlet through which fluid is introduced into the pump chamber and an outlet through which pressurized fluid is discharged from the pump chamber;

a pot connected to the bottom of at least one of the slots having vanes moving inwardly in the respective slots;

a conduit connected at its one end to the port and at the other end thereof to the outlet of the pump chamber;

a restriction orifice placed in the conduit; and means for moving the cam ring with respect to the rotor to vary the capacity of the vane pump in response to a pressure differential across the restriction orifice.

2. The variable capacity type vane pump as claimed in claim 1, further including means for connecting the bottom of at least one of the slots having vanes moving outwardly in the respective slots to the outlet of the pump chamber.

3. The variable capacity type vane pump as claimed in claim 1, wherein the restriction orifice has a variable area, the restriction orifice including means responsive to an electric signal for varying the area of the restriction orifice.

4. A vane pump of the type having a variable capacity, comprising:

a cam ring;

a rotor placed for rotation within the cam ring, the rotor having a number of radial slots, and vanes placed for radial inward and outward movement in the respective slots each having a bottom;

a pump chamber defined between the cam ring and the rotor, the pump chamber having an outlet and inlet port;

means for connecting the bottom of at least one of the slots having vanes moving inwardly in the respective slots to the outlet port of the pump chamber through a conduit;

a restriction orifice placed in the conduit, the restriction orifice having a variable area, the restriction orifice inducing means responsive to an electric signal for varying the area of the restriction orifice; and means for moving the cam ring with respect to the rotor to vary the capacity of the vane pump in response to a pressure differential across the restriction orifice.

5. The variable capacity type vane pump as claimed in claim 4, further including means responsive to a pressure at the outlet of the pressure chamber for connecting the inlet and outlet of the pressure chamber when the pressure exceeds a predetermined value.

6. The variable capacity type vane pump as claimed in claim 4, further including means for connecting the bottom of at least one of the slots having vanes moving outwardly in the respective slots to the outlet port of the pump chamber.

7. The variable capacity type vane pump as claimed in claim 4, further including means responsive to a pressure at the outlet port for connecting the inlet and outlet ports when the pressure exceeds a predetermined value.

* * * * *